US005564155A

United States Patent [19]

Monesson

[11] Patent Number: 5,564,155

[45] Date of Patent: Oct. 15, 1996

[54] REMOVABLE LINER FOR CANISTER-TYPE VACUUM CLEANER

[76] Inventor: Joel Monesson, 45 Burlington Dr., Brick, N.J. 08723

[21] Appl. No.: 513,606

[22] Filed: Aug. 10, 1995

[51] Int. Cl.[6] ..... A47L 9/00

[52] U.S. Cl. ..... 15/246.2; 15/327.1; 15/352; 55/379

[58] Field of Search ..... 15/339, 347, 353, 15/246.2, 352; 55/379, 429

[56] References Cited

U.S. PATENT DOCUMENTS

| | | | |
|---|---|---|---|
| 3,568,413 | 3/1971 | Jerabek | 55/379 |
| 3,653,190 | 4/1972 | Lee et al. | 15/352 X |
| 3,740,933 | 6/1973 | Hollowell | 15/352 X |
| 4,467,494 | 8/1984 | Jones | 15/352 X |
| 4,531,258 | 7/1985 | Spellman | 55/379 X |
| 4,575,895 | 3/1986 | Spellman | 15/327.1 |
| 5,145,499 | 9/1992 | Dyson | 15/352 X |

*Primary Examiner*—Chris K. Moore
*Attorney, Agent, or Firm*—Charles I. Brodsky

[57] ABSTRACT

A removable liner for a canister-type vacuum cleaner incorporating a bin, a vacuum blower having an inlet leading to the interior of the bin and an outlet leading to the atmosphere, and a bag within the interior of the bin for collecting trash and other debris to be disposed of along with the bag, with the liner comprising a flexible, coilable sleeve to fit into the bag, of a width to unfurl to expand the bag towards the wall of the bin, and of a rigidity to maintain its unfurled shape and the expansion of the bag against the suction of the vacuum blower.

10 Claims, 4 Drawing Sheets

REMOVABLE LINER FOR CANISTER-TYPE VACUUM CLEANER

FIELD OF THE INVENTION

This invention relates to canister-type vacuum cleaners and, more particularly, to those used in commercial and/or industrial locations to collect such debris as dust, dirt, noxious substances and other "dry" materials.

BACKGROUND OF THE INVENTION

As is known and understood, many different makes of canister-type vacuum cleaners are available for commercial or industrial use, as compared to the typical vacuum-cleaner design used residentially. Sold under such names as Black & Decker, Shop Vac, Wet-Dry Vac, Eureka, Hoover and Sears, these types of machines all include a cylindrical bin having a vacuum blower connected at its upper end and a pick-up hose coupled to it either at its top, or through its side. As contrasted with the "residential" type vacuum cleaner, noted to be absent is any type of disposable collection bag. Thus, once the cylindrical bin is filled, it is then carried outside and dumped. Usually, with "dry" materials being collected, the result is a blowing up of a dust cloud in the user's face. To avoid this, suggestions have been made to line the bin with a plastic disposable bag before use so that the bag can be tied once filled, removed from the bin and disposed of in any available, permissible manner. Many of these attempts, however, proved unsuccessful in that the disposable plastic bag got sucked in at the filter mechanism or at the outlet to the external atmosphere. These attempts quickly proved unusable, and led to further attempts to solve the problem.

In one, described in U.S. Pat. No. 3,740,933, a rigid cylindrical liner is slipped inside the bag, and the combination then placed in the trash collecting bin. Said to prevent the plastic bag from collapsing and blocking the air flow, the liner could then be slipped out of the bag and re-used; but, such liner, as described, is available only with a canister-type cleaner having a vacuum blower in the top of the canister and is of a rigid, cylindrical construction designed to fit only a given canister size, so that different ones would be required when working with canisters of either 8 gallon, 12 gallon, 16 gallon, or even 1 gallon capacities. In a second arrangement, as described in U.S. Pat. No. 4,575,895, a basket form holds the disposable plastic bag in place, with its disadvantage that the cross members at its bottom tends to pull the debris from the collecting bag when removing the basket, along with its being costly to produce and manufacture. In fact, analysis has shown that the cost of the basket itself might run to 10% and more as compared to the cost of the canister machine with which it is to be used.

OBJECTS OF THE INVENTION

It is an object of the present invention, therefore, to provide a new and improved removable liner for these canister-type machines which is inexpensive to manufacture and simple in its operation.

It is another object of the invention to provide such a liner which can be virtually universal in its operation, in fitting different canister manufactures, of a wide variety of capacities.

It is a further object of the invention to provide such a removable liner for use either with canisters having the vacuum inlet at either the top or side of the cylindrical bin.

It is yet another object of the invention to provide this liner of a design to be used regardless of the size of the canister machine, regardless of the location of its vacuum inlet, and of an inexpensive, reusable design.

SUMMARY OF THE INVENTION

As will become clear from the following description, a removable liner of this type comprises a flexible, coilable sleeve to fit into the disposable plastic bag, of a width to unfurl to expand the bag towards the walls of the cylindrical bin, and of a rigidity to maintain its unfurled shape and the expansion of the bag against the suction of the vacuum cleaner. As will be seen, the sleeve is of a height less than that of the canister bin, and preferably at least one-half its height. To fit within a variety of canister bins of differing diameter, the sleeve of the invention is preferably of an adjustable length, either with a plurality of pre-measured score-lines for cutting to match the diameter of the particular canister being used, or with a plurality of pre-measured score-lines and tabs for tearing to match the particular canister diameter. So as to be operable with both top and side vacuum-inlet machines, the liner sleeve further includes a plurality of vertically displaced openings along a top edge thereof for coupling the liner and the bag to the side-vacuum blower inlet of the particular canister bin in the machine then being employed. In such alternative construction, the vertically displaced openings will be seen to be of a diameter slightly greater than the diameter of the vacuum blower inlet itself. As will be understood by those skilled in the art, once such liner sleeve is constructed of a molded plastic composition—as of polypropylene—the liner can be rolled up and tethered closed for storage when not used, and then, once placed into the disposable plastic bag inserted into the bin, unfurls to expand the bag towards the walls of the bin, and of the required rigidity to maintain the unfurled shape in holding the bag against the suction of the vacuum cleaner, in preventing its clogging of either the air inlets or outlets. In this way, a universal, removable liner is described, available for use with all those machines available on the market for commercial and industrial use for collecting "dry" debris.

BRIEF DESCRIPTION OF THE DRAWING

These and other features of the present invention will be more clearly understood from a consideration of the following description, taken in connection with the accompanying drawing, in which.

DETAILED DESCRIPTION OF THE DRAWING

Figure 1:
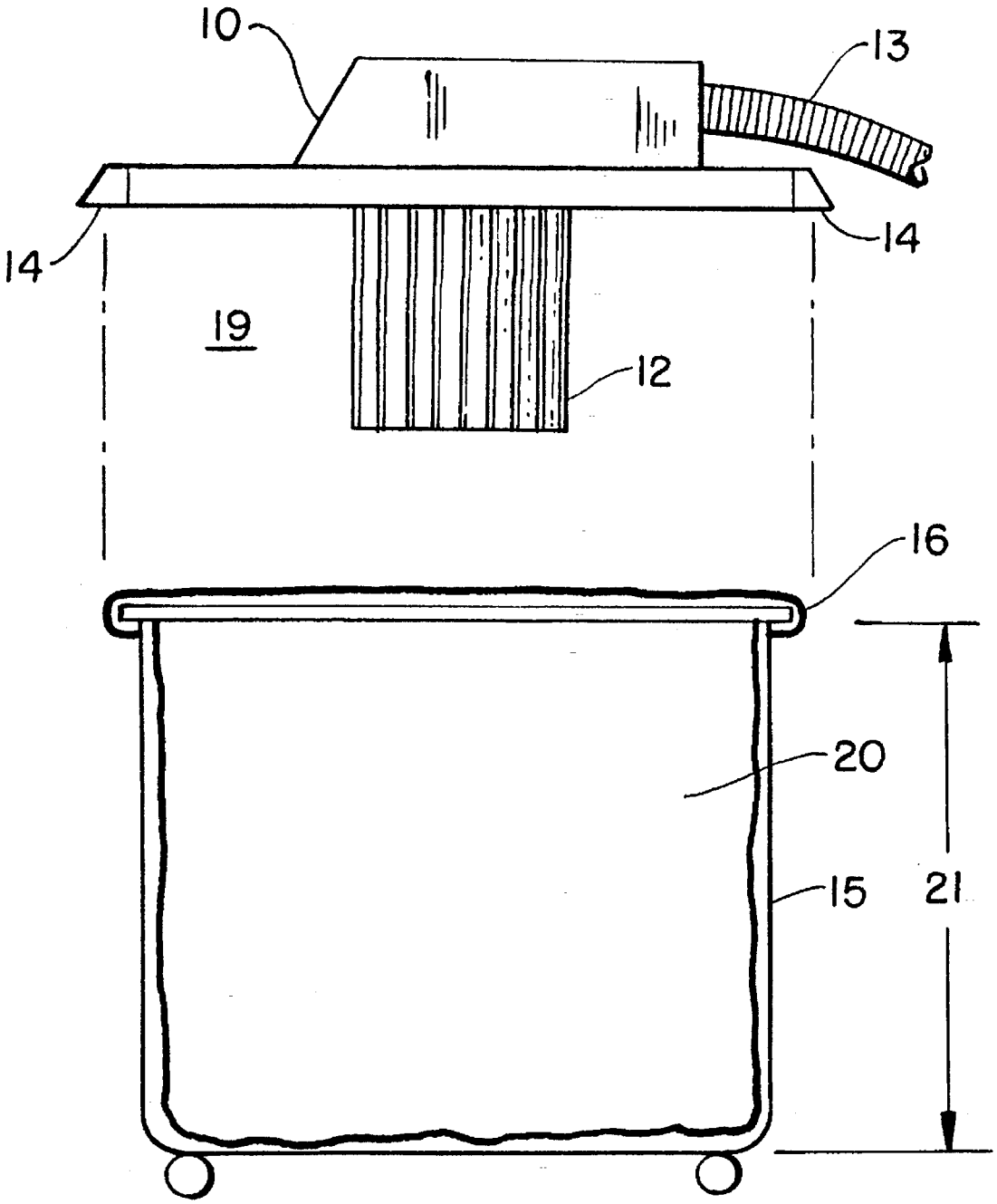
FIG. 1 schematically illustrates a canister-type vacuum cleaner construction employing a top vacuum inlet with which the removable liner of the invention is particularly attractive.

In FIG. 1, a motor 10, filter 12 and hose inlet 13 are located in a unit 19 to be mounted atop a drum or canister collection receptacle or cylindrical bin 15. A disposable plastic bag 20 overlies the lip 16 of the bin 15, and is tucked inside. A cover 14 closes off the canister when in use. As is known, such bag 20 often gets sucked into the filter 12 once the motor is turned on.

In accordance with the invention, however, a molded, flexible plastic liner 17 (FIG. 2) is employed as a coilable sleeve, to be placed inside the disposable bag 20 in the bin 15, and of a length L to unfurl to expand the bag towards the inside walls of the bin 15, and of a rigidity to maintain its unfurled shape and the expansion of the bag 20 against the suction of the vacuum cleaner. In particular, the coilable sleeve 17 is selected of a height H less than the height 21 of the canister bin, preferably a height at least one-half the height 21 of the bin 15. As shown, the sleeve 17 is of an adjustable length to fit within a variety of canister bins of differing diameter.

Figure 4:
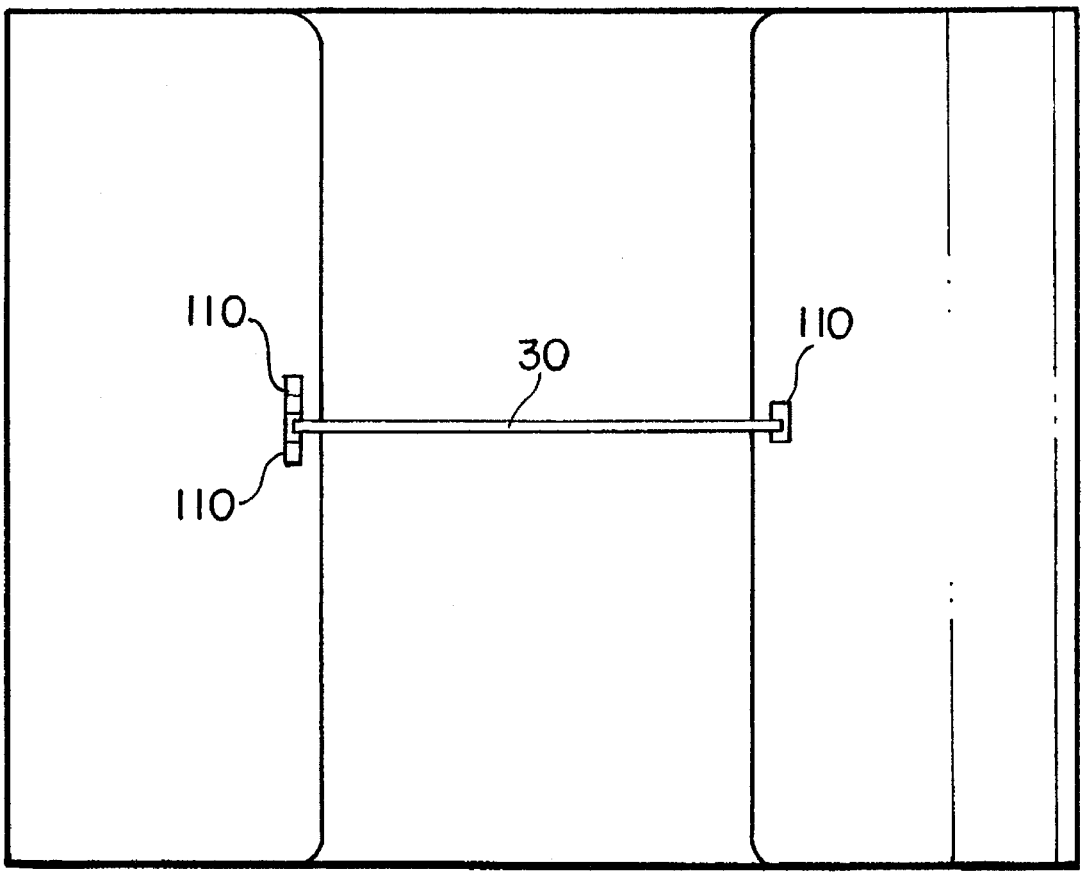
FIG. 4 shows a coiled removable liner embodying the invention with a tether to maintain the liner in a furled position for easier handling and storage.

In accordance with the invention, the adjustable length is obtained by having a plurality of pre-measured score-lines 22, 24, 26, 28 which can be cut to match the diameter of the particular canister being used. Thus, and as will be appreciated, if none of the score-lines are cut, the coilable sleeve 17 is of its greatest dimension, with greatest length L and height H. Cutting on the score-line 28 will be seen to shorten the length and lower the height, for use with a canister having a smaller diameter cylindrical bin and a lesser capacity. Cutting on the score-line 26, on the other hand, enables the coilable sleeve 17 to be utilized with a cylindrical bin 15 of yet a further smaller diameter, as also follows if the score-lines 24 or 22 were cut. Thus, if one were to cut along the score-line 22, the resultant cut-out sleeve 100 would then serve as the liner for the smallest cylindrical receptacle. Cutting, instead, along the score-line 24, would give a larger sleeve 101 for a larger bin—and a similar result would follow if the cutting were along the score-line 26 or 28, to give progressively larger sized sleeves 102, 103, with the largest sleeve 104 being obtainable where no score-line cutting is employed. In a preferred embodiment of the invention, a liner of this type could be provided with a length L of 50 inches, and a height H of 14¼ inches. The score-line 22 could then be cut at a length $L_1$ of 24 inches and a height $H_1$ of 4½ inches. The score-line 24, in this preferred embodiment, could be cut at a length $L_2$ of 36 inches and a height $H_2$ of 10¼ inches. Comparable lengths $L_3$ and $L_4$ have proved useful for the score-lines 26 and 28 of 40 inches and 45 inches, respectively, along with heights $H_3$ and $H_4$ of 11¼ inches and 12¼ inches in corresponding fashion. Once cut to the proper dimension to fit the size of the cylindrical bin 15 being used, the sleeve 100, 101, 102, 103, 104 is inserted as the coilable liner 17 into the opened bag 20, where it unfurls to expand it against the bin walls to hold it in position against the suction of the vacuum cleaner. Further openings 110 are cut at opposite sides of the sleeve to receive a tether 30 (FIG. 4) to coil up the liner for storage when not in use. Once it becomes time to get rid of the disposable plastic bag and its collected debris, the unfurled liner is simply removed from the receptacle, the bag tied off, and then carried to the dumpster or other site for disposal. As an alternative to cutting the pre-measured score-lines 22, 24, 26, 28, a plurality of tabs 32, 34, 36, 38 are shown at the score lines, which when pulled, would tear and produce the same results as cutting along the score-lines, in matching the liner to the diameter of the particular canister being used.

Figure 2:
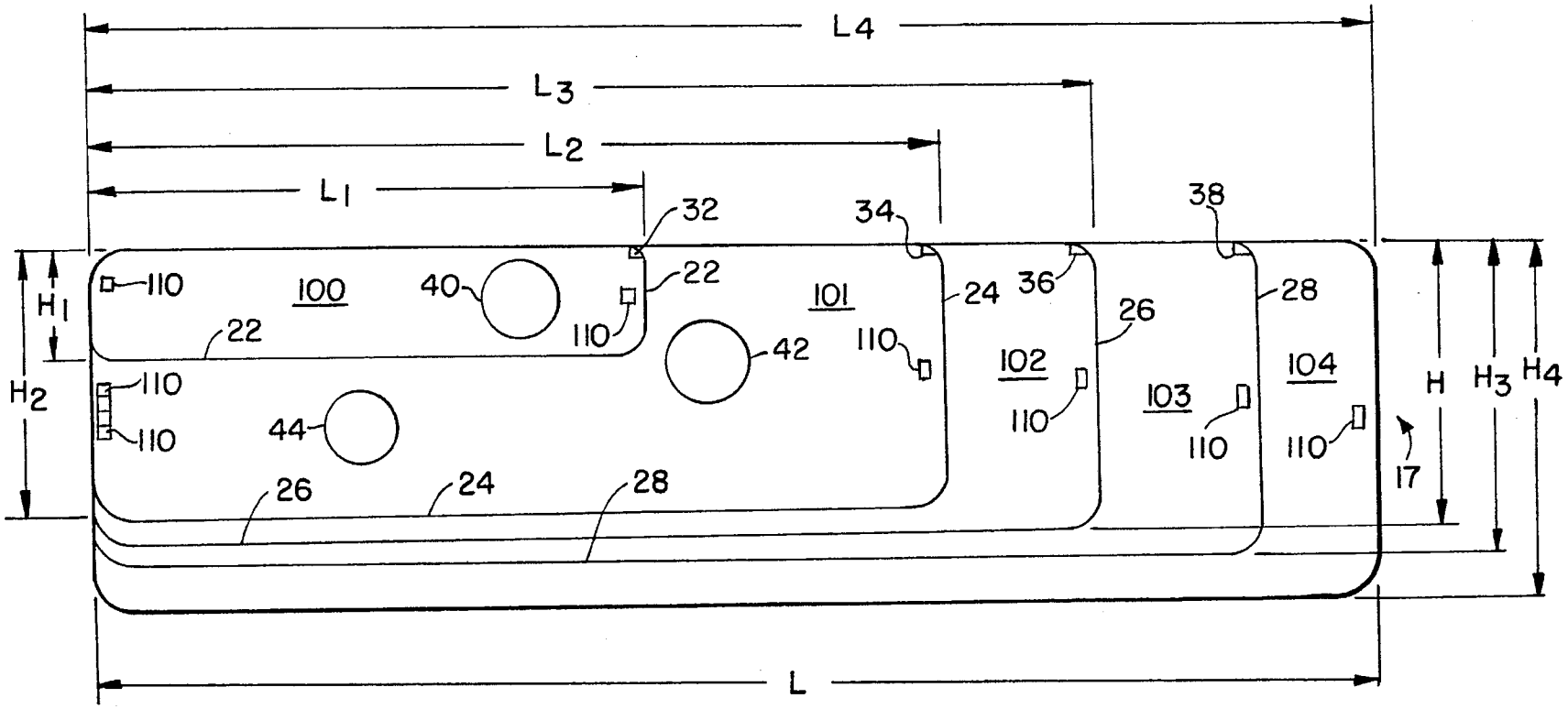
FIG. 2 illustrates the removable liner of the invention for use with the canister cleaner of FIG. 1.
Figure 3:
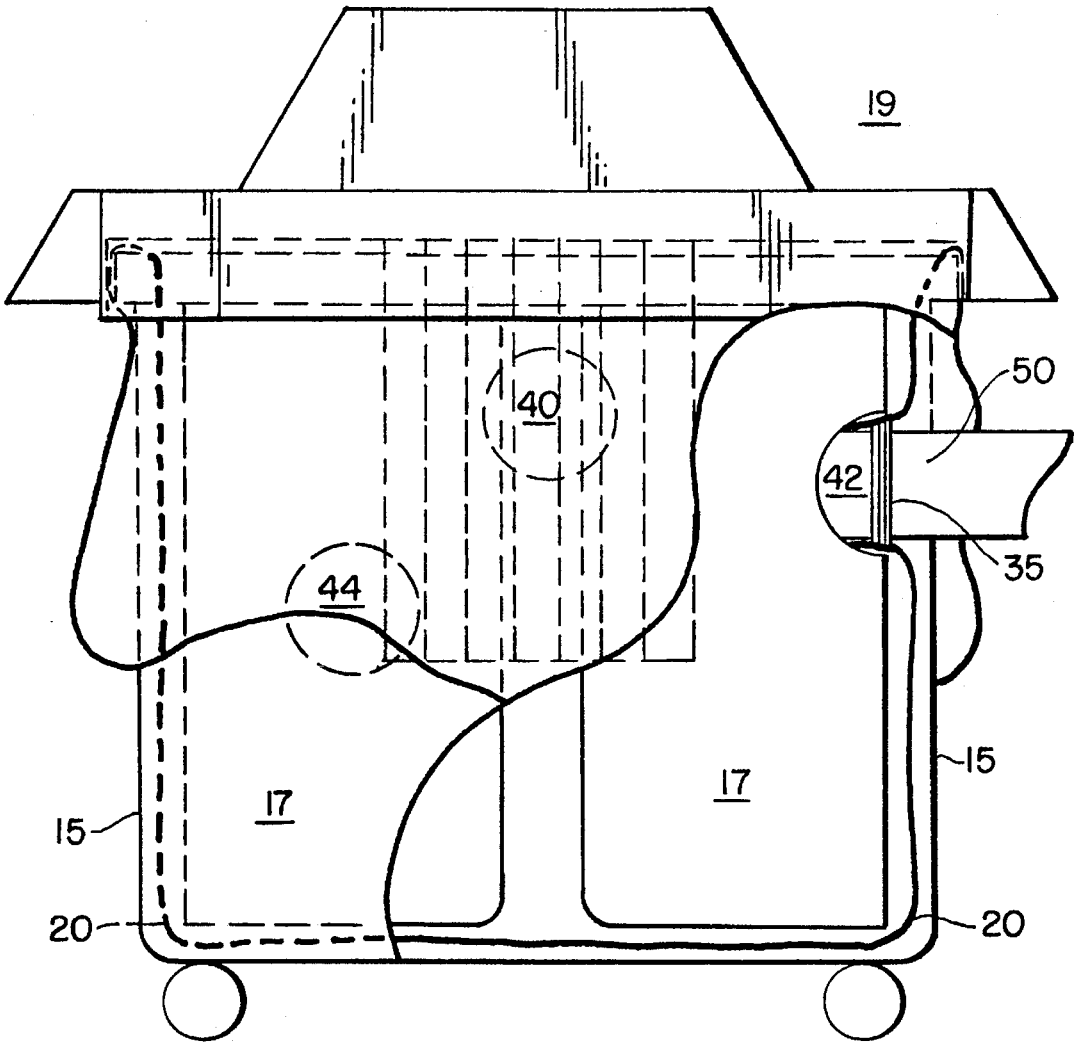
FIG. 3 illustrates the removable liner of FIG. 2 as utilized in a canister-type construction having a vacuum inlet at the side, rather than at the top, of the construction.

As also shown in FIG. 2, the liner 17 includes a plurality of vertically displaced openings 40, 42, 44 along the liner for coupling the liner and the bag employed in a canister having a vacuum inlet cut into the side. Three such openings are shown, of 3 inch diameter each, to match with the side vacuum inlets typically found at various locations in available manufactures, of some 2½ inch diameters each. Shown by the configuration of FIG. 3, once the disposable bag is placed into the canister bin 15, the appropriate opening 40, 42, 44 can be fitted over the location of the interior vacuum inlet at the side, cutting an opening into the disposable bag, and securing the bag about the inlet of the appropriate opening, by means of a common elastic band 35. Once the disposable bag is full, it can then be slipped off the inlet opening, shown by the reference numeral 50, and the cut in the bag then closed and secured with the elastic band 35. Once again, the liner 17 can then be removed from the bag and canister bin, the bag sealed at its top, removed and disposed of in any appropriate manner. With the liner being constructed of a molded plastic composition—such as of polypropylene—, the liner can then be stored away, ready for use at a later time.

In either event, what is thus described, constitutes a liner sleeve as shown in FIG. 2, ready for sale as a universal liner, for use with all the many different types of canister vacuum cleaners presently on the market, regardless of the size and capacity, and independent of whether the machine be provided with a top or side vacuum inlet. All that is required is to purchase the liner of FIG. 2, and then adjust it to size to meet the requirements of the individual machine at hand. Furthermore, by manufacturing the liner of the flexible, coilable design set forth, and of a rigidity to maintain its unfurled shape—as when fabricated of polypropylene—, it even becomes practicable to divide the single liner of FIG. 2 along individual ones or several of the score-lines 22, 24, 26 or 28 to have a series of liners, each of which is intended to operate with a different size canister machine, if several be available for use at the same location.

While there have been described what are considered to be preferred embodiments of the present invention, it will be readily apparent to those skilled in the art that modifications can be made without departing from the scope of the teachings herein of having a universal vacuum bag support system for a canister-type machine, of a manufacture amenable for continued re-use, and at a cost which is reasonably low following from the method of manufacture set forth. For at least such reasons, therefore, resort should be had to the claims appended hereto for a true understanding of the scope of the invention.

I claim:

1. A removable liner for a canister-type vacuum cleaner incorporating a bin, a vacuum blower having an inlet leading to the interior of the bin and an outlet leading to the atmosphere, and a bag within the interior of the bin for collecting trash and other debris to be disposed of along with the bag, said liner comprising a flexible, coilable sleeve for fitting into said bag within said bin, of a width to unfurl to expand said bag towards the walls of said bin, and of a rigidity to maintain its unfurled shape and the expansion of said bag against the suction of said vacuum cleaner.

2. The removable liner of claim 1 wherein said sleeve is of a height less than the height of said canister bin.

3. The removable liner of claim 2 wherein said sleeve is of a height at least one-half the height of said canister bin.

4. The removable liner of claim 1 wherein said sleeve is of an adjustable length to fit within a variety of canister bins of differing diameters.

5. The removable liner of claim 4 wherein said sleeve is of a given length, with a plurality of pre-measured score-lines for cutting to match the diameter of the particular canister being used.

6. The removable liner of claim 4 wherein said sleeve is of a given length, with a plurality of pre-measured score-lines and tabs for tearing to match the diameter of the particular canister being used.

7. The removable liner of claim 1 wherein said sleeve includes a plurality of vertically displaced openings along an edge thereof for coupling said liner and said bag to the vacuum blower inlet of the particular canister bin being used.

8. The removable liner of claim 7 wherein said vertically displaced openings of said sleeve are of a diameter slightly greater than the diameter of said vacuum blower inlet.

9. The removable liner of claim 1 wherein said sleeve is constructed of a molded plastic composition.

10. The removable liner of claim 9 wherein said sleeve is constructed of polypropylene.

* * * * *